US009868032B2

(12) United States Patent
Nardacci et al.

(10) Patent No.: US 9,868,032 B2
(45) Date of Patent: Jan. 16, 2018

(54) GOLF BALL DIMPLE PROFILE

(71) Applicant: Acushnet Company, Fairhaven, MA (US)

(72) Inventors: Nicholas M. Nardacci, Barrington, RI (US); Michael R. Madson, Easton, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 14/985,482

(22) Filed: Dec. 31, 2015

(65) Prior Publication Data

US 2016/0175657 A1 Jun. 23, 2016

Related U.S. Application Data

(63) Continuation-in-part of application No. 14/953,641, filed on Nov. 30, 2015, which is a continuation-in-part of application No. 14/835,819, filed on Aug. 26, 2015, now abandoned, which is a continuation of application No. 13/341,652, filed on Dec. 30, 2011, now abandoned.

(51) Int. Cl.
*A63B 37/12* (2006.01)
*A63B 37/00* (2006.01)

(52) U.S. Cl.
CPC ..... *A63B 37/0006* (2013.01); *A63B 37/0003* (2013.01); *A63B 37/0012* (2013.01); *A63B 37/0021* (2013.01); *A63B 37/002* (2013.01); *A63B 37/0018* (2013.01); *A63B 37/0019* (2013.01)

(58) Field of Classification Search
CPC ..... A63B 37/0012
USPC ..... 473/378, 383
See application file for complete search history.

(56) References Cited

U.S. PATENT DOCUMENTS 6,464,601 B2 * 10/2002 Ogg ..... A63B 37/0004 473/383
8,137,217 B2 3/2012 Madson et al.

* cited by examiner

*Primary Examiner* — Raeann Gorden
(74) *Attorney, Agent, or Firm* — Kristin D. Wheeler

(57) ABSTRACT

Golf ball dimples having a cross-sectional profile shape defined by the product of a base profile and one or more weighting functions are disclosed.

22 Claims, 28 Drawing Sheets

GOLF BALL DIMPLE PROFILE

CROSS-REFERENCE TO RELATED APPLICATIONS

This application is a continuation-in-part of co-pending U.S. patent application Ser. No. 14/953,641, filed Nov. 30, 2015, which is a continuation-in-part of U.S. patent application Ser. No. 14/835,819, filed Aug. 26, 2015, which is a continuation of U.S. patent application Ser. No. 13/341,652 filed Dec. 30, 2011, now abandoned, the entire disclosures of which are hereby incorporated by reference.

FIELD OF THE INVENTION

The present invention is directed to a golf ball dimple cross-sectional profile defined by the product of a base profile and one or more weighting functions.

BACKGROUND OF THE INVENTION

U.S. Pat. No. 4,681,323 to Alaki et al. discloses a golf ball with a plurality of recessed dimples having a shape in accordance with a certain mathematical ratio on the surface thereof.

U.S. Pat. No. 4,840,381 to Ihara et al. discloses a golf ball characterized by the shape of its dimples. The dimples have a more gentle transition over their edge portion than prior art golf balls wherein dimple edges sharply intrude into the ball surface.

U.S. Pat. No. 6,331,150 to Ogg discloses a golf ball having a surface thereon with a plurality of dimples on the surface. The contour of each of the dimples is continuous from a first edge of each of the dimples to a second opposing edge of each of the dimples.

Additional background references include, for example, U.S. Pat. No. 4,813,677 to Oka et al. and U.S. Pat. No. 4,840,381 to Ihara et al.

SUMMARY OF THE INVENTION

The present invention is generally directed to a golf ball having a plurality of recessed dimples on the surface thereof, at least a portion of which have a cross-sectional profile defined by a weighted profile. The weighted profile is the product of a base profile and at least one weighting function. In a particular embodiment, the base profile is defined by a single function. In another particular embodiment, the base profile is defined by a single continuous, differentiable function.

BRIEF DESCRIPTION OF DRAWINGS

In the accompanying drawings, which form a part of the specification and are to be read in conjunction therewith, and which are given by way of illustration only, and thus are not meant to limit the present invention.

DETAILED DESCRIPTION

Figure 1:
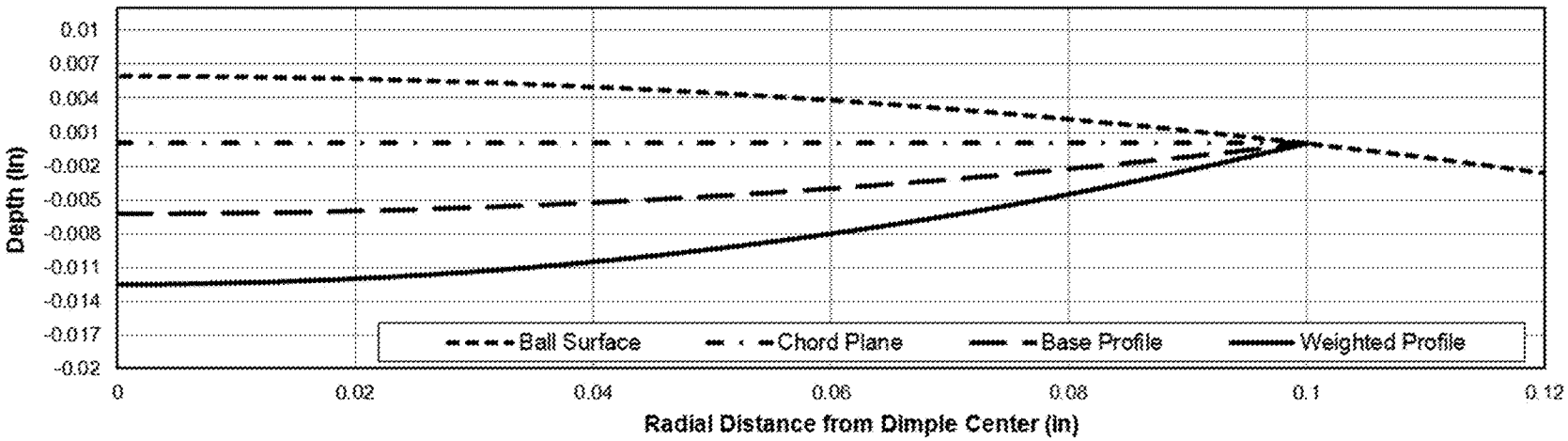
FIG. 1 shows a dimple cross-sectional profile defined by the product of a spherical base profile and a weighting function according to one embodiment of the present invention.
Figure 2:
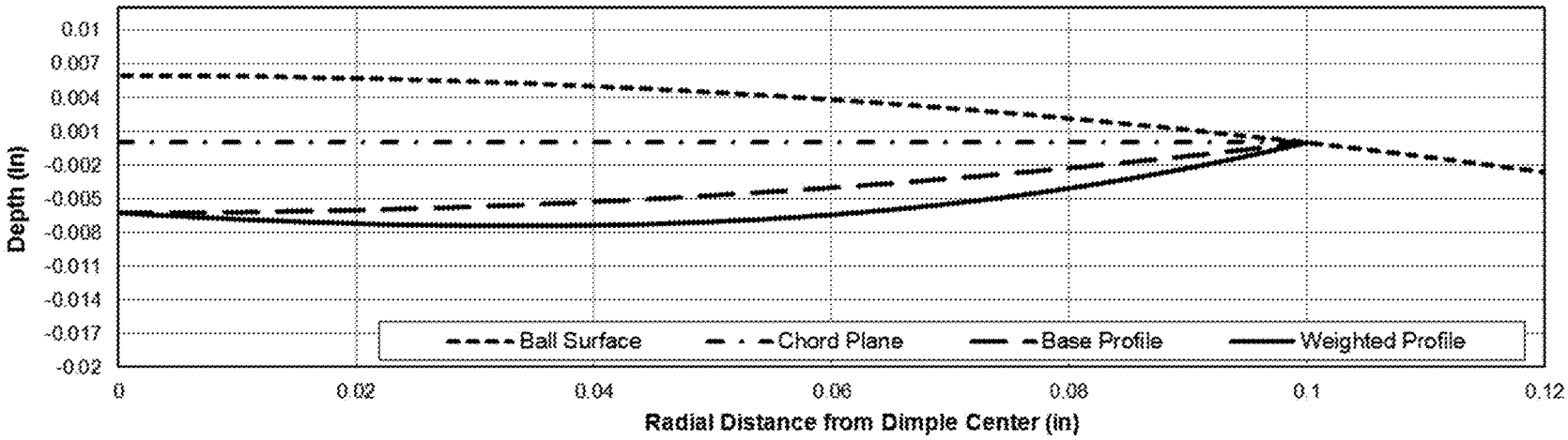
FIG. 2 shows a dimple cross-sectional profile defined by the product of a spherical base profile and a weighting function according to another embodiment of the present invention.
Figure 3:
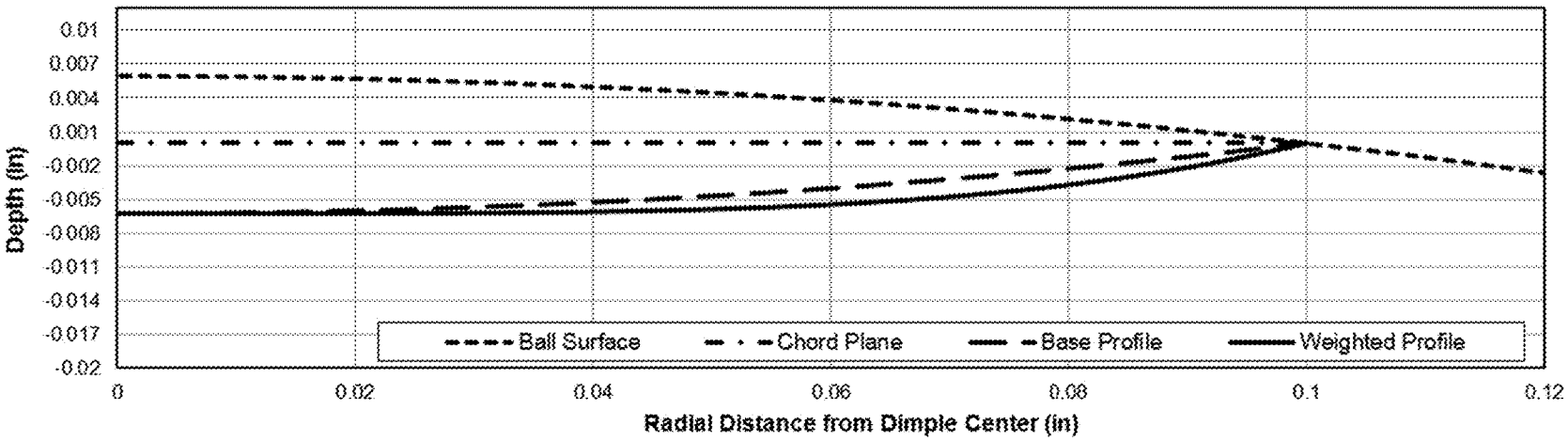
FIG. 3 shows a dimple cross-sectional profile defined by the product of a spherical base profile and a weighting function according to another embodiment of the present invention.
Figure 4:
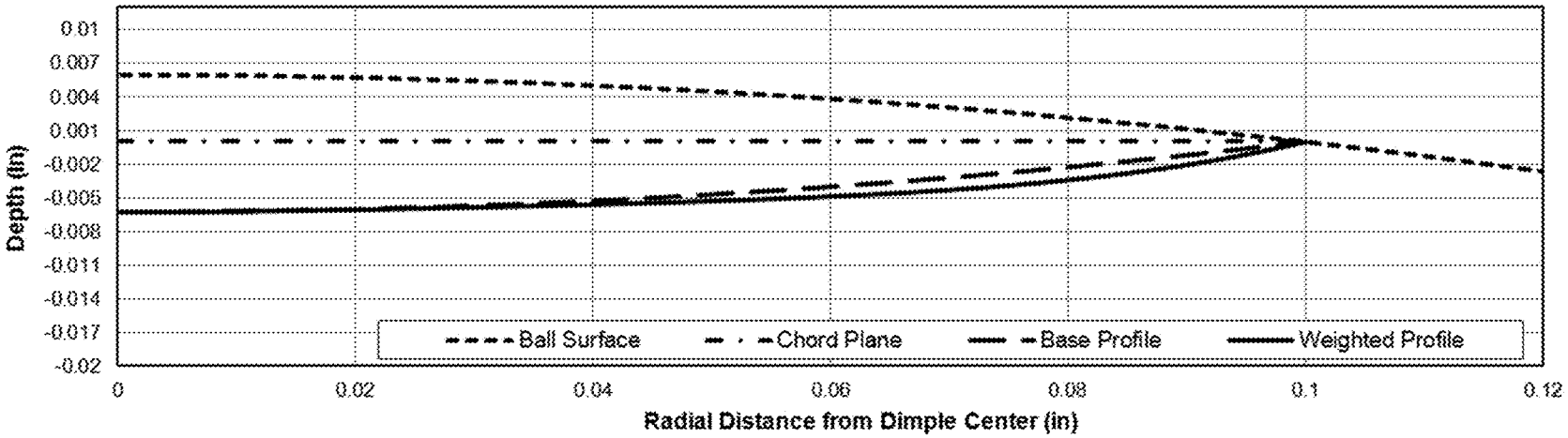
FIG. 4 shows a dimple cross-sectional profile defined by the product of a spherical base profile and a weighting function according to another embodiment of the present invention.
Figure 5:
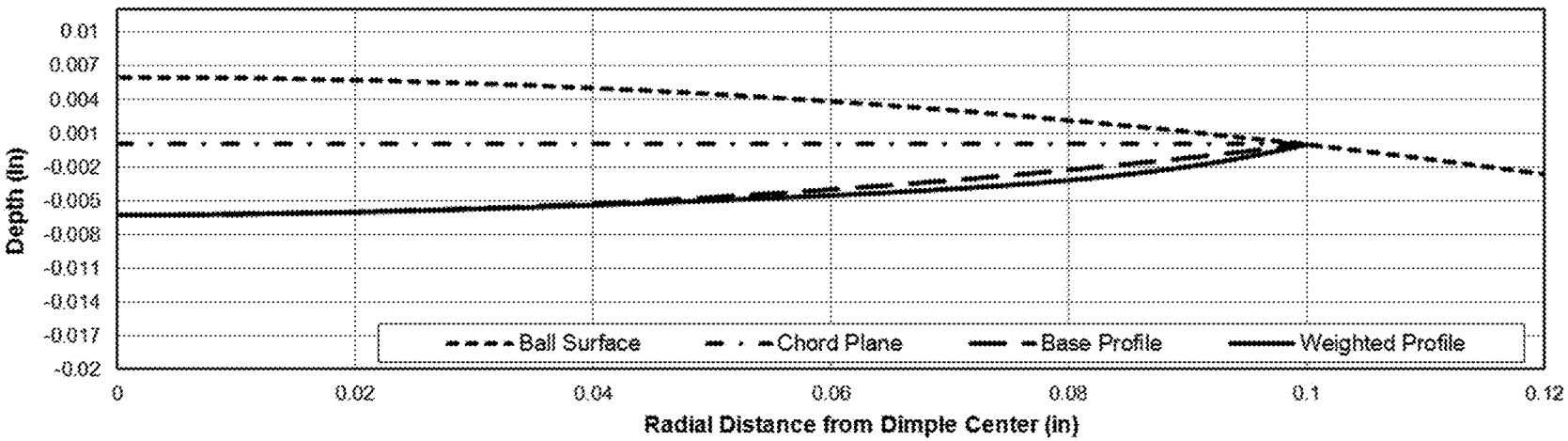
FIG. 5 shows a dimple cross-sectional profile defined by the product of a spherical base profile and a weighting function according to another embodiment of the present invention.
Figure 6:
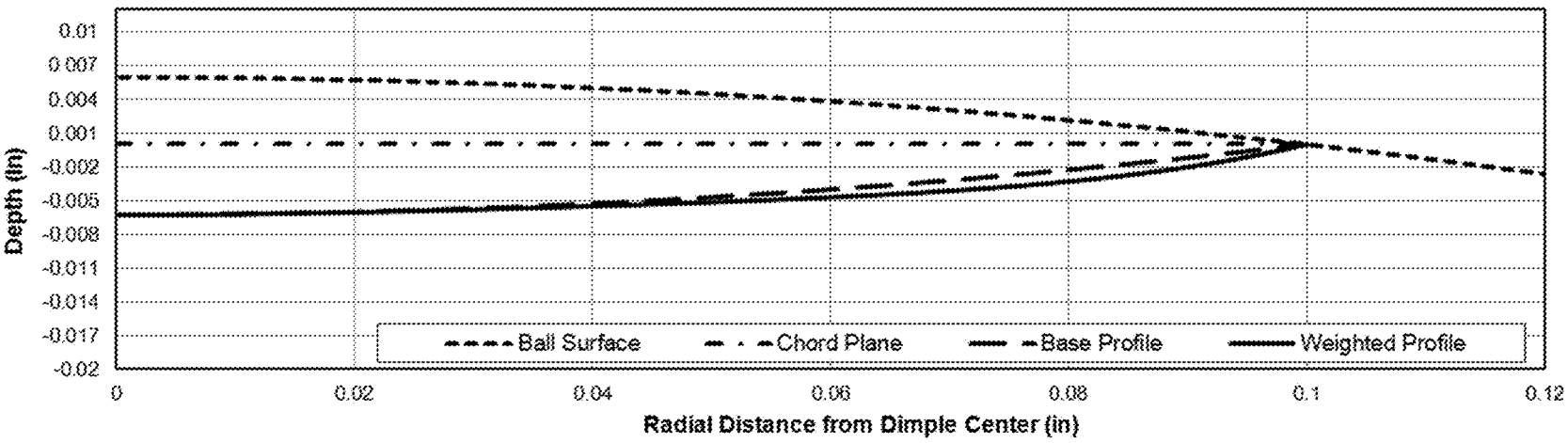
FIG. 6 shows a dimple cross-sectional profile defined by the product of a spherical base profile and a weighting function according to another embodiment of the present invention.
Figure 7:
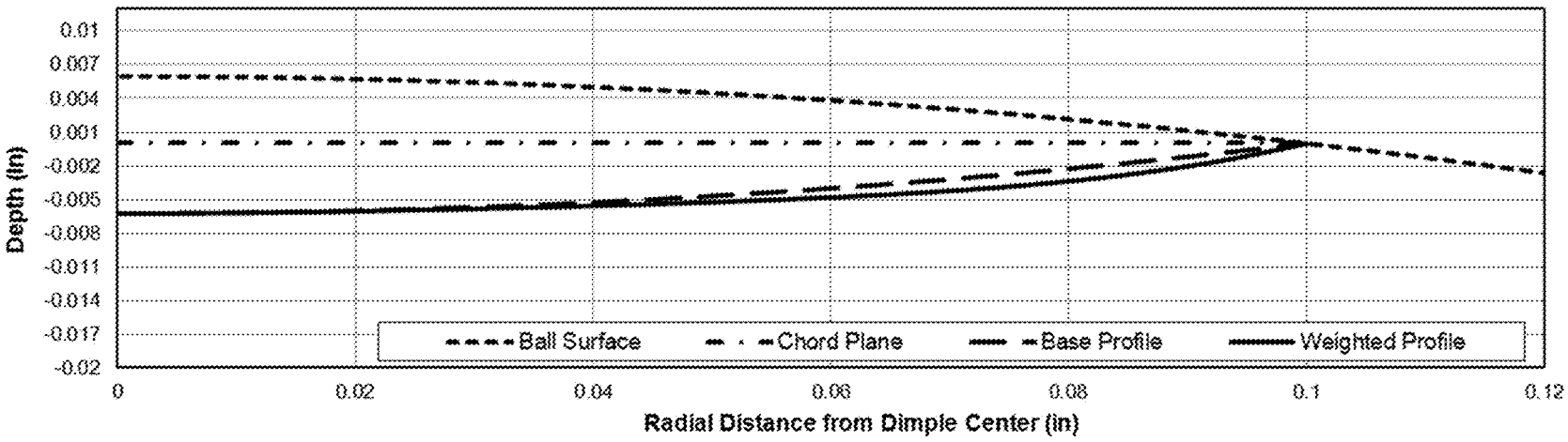
FIG. 7 shows a dimple cross-sectional profile defined by the product of a spherical base profile and a weighting function according to another embodiment of the present invention.
Figure 8:
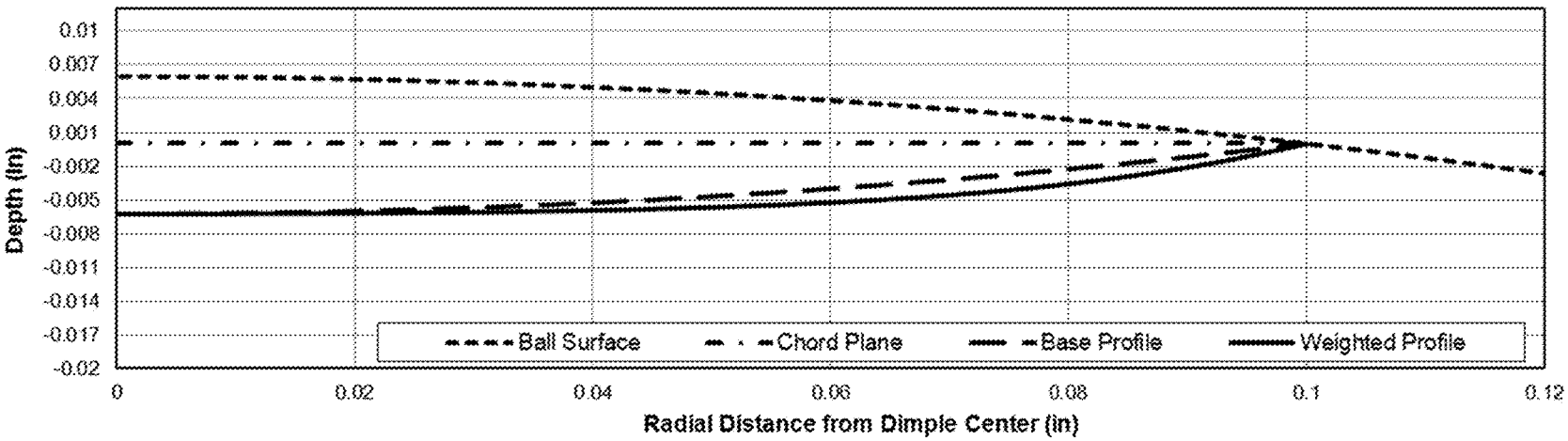
FIG. 8 shows a dimple cross-sectional profile defined by the product of a spherical base profile and a weighting function according to another embodiment of the present invention.
Figure 9:
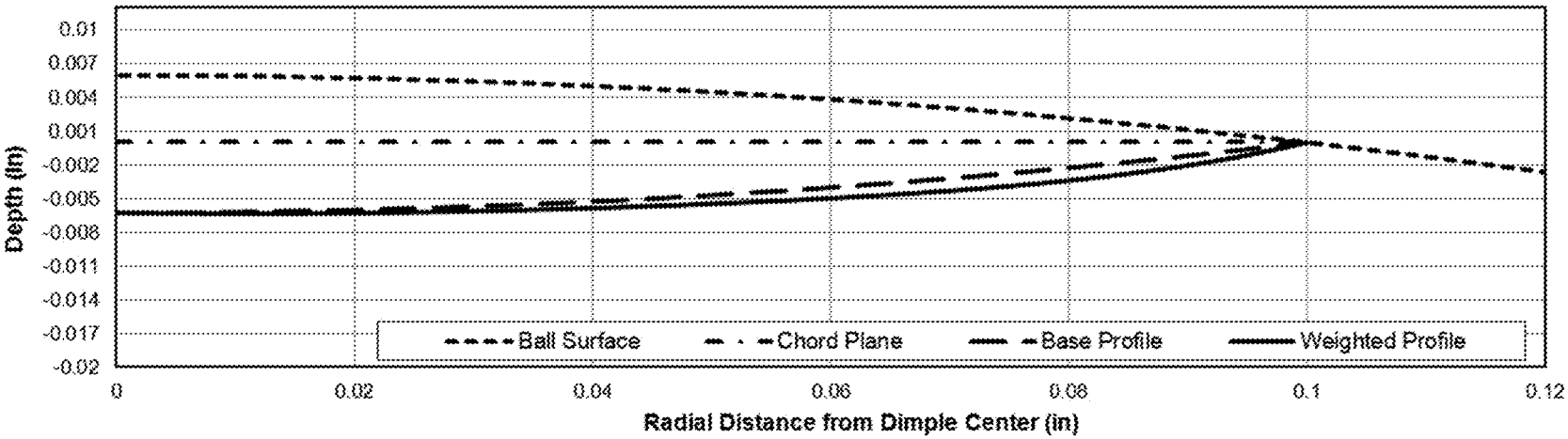
FIG. 9 shows a dimple cross-sectional profile defined by the product of a spherical base profile and a weighting function according to another embodiment of the present invention.
Figure 10:
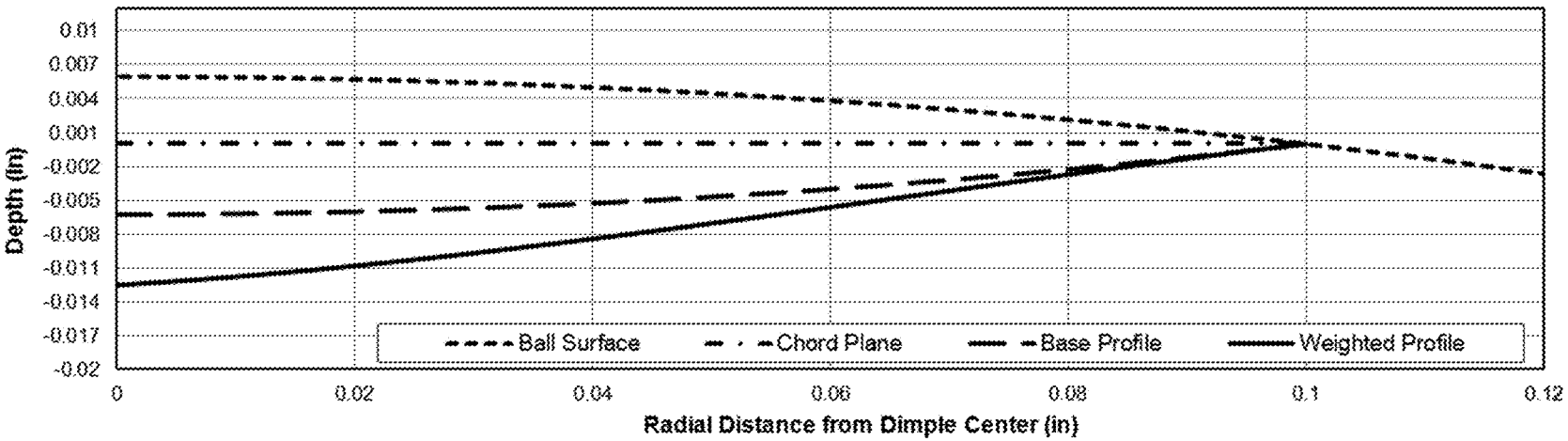
FIG. 10 shows a dimple cross-sectional profile defined by the product of a spherical base profile and a weighting function according to another embodiment of the present invention.
Figure 11:
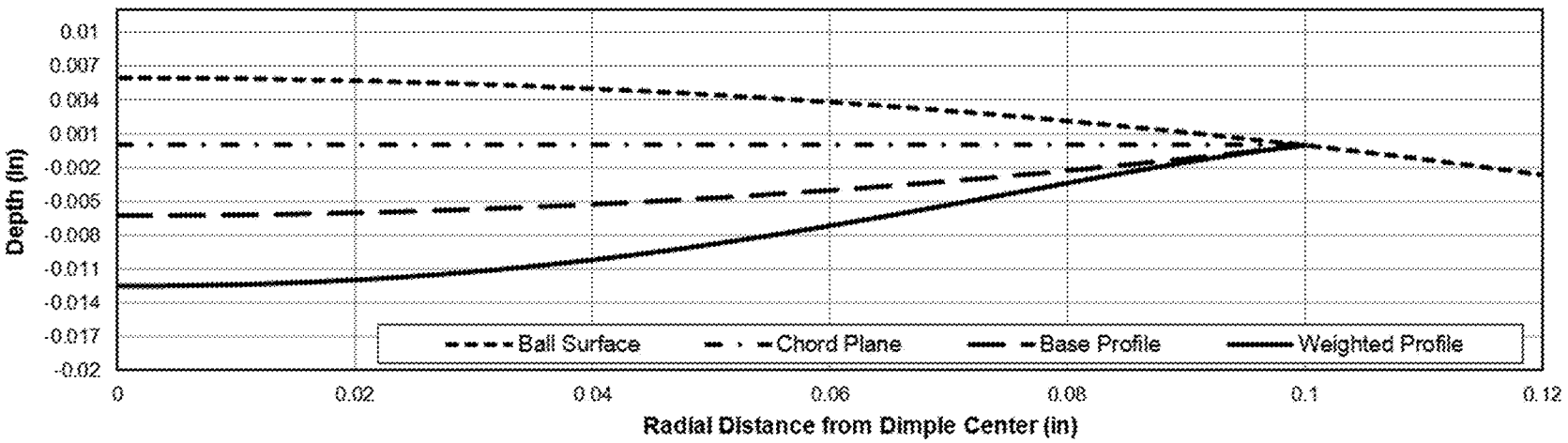
FIG. 11 shows a dimple cross-sectional profile defined by the product of a spherical base profile and a weighting function according to another embodiment of the present invention.
Figure 12:
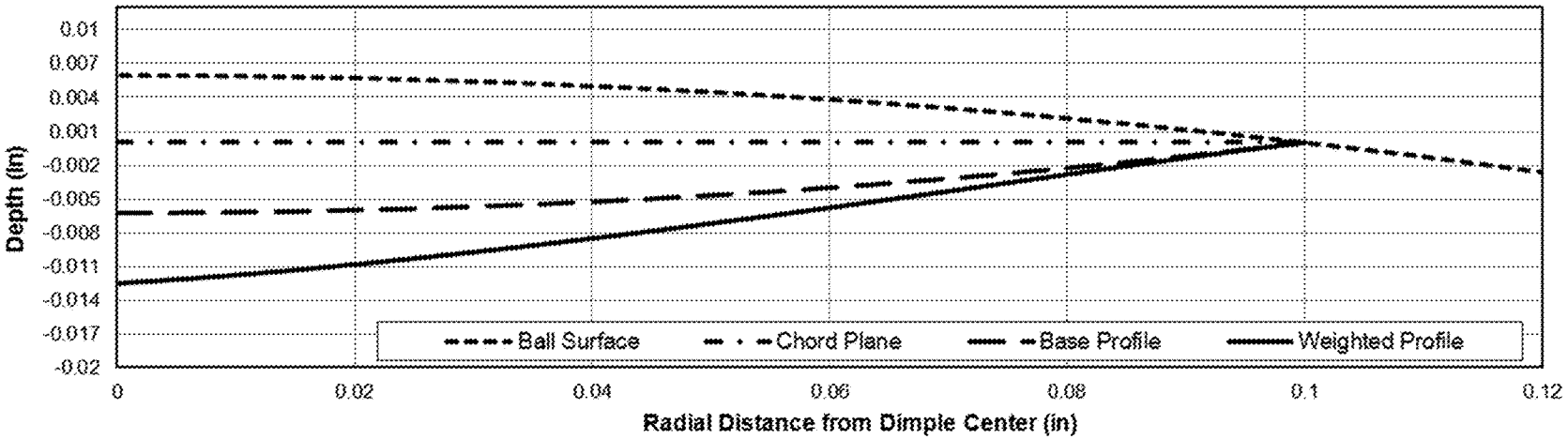
FIG. 12 shows a dimple cross-sectional profile defined by the product of a spherical base profile and a weighting function according to another embodiment of the present invention.
Figure 13:
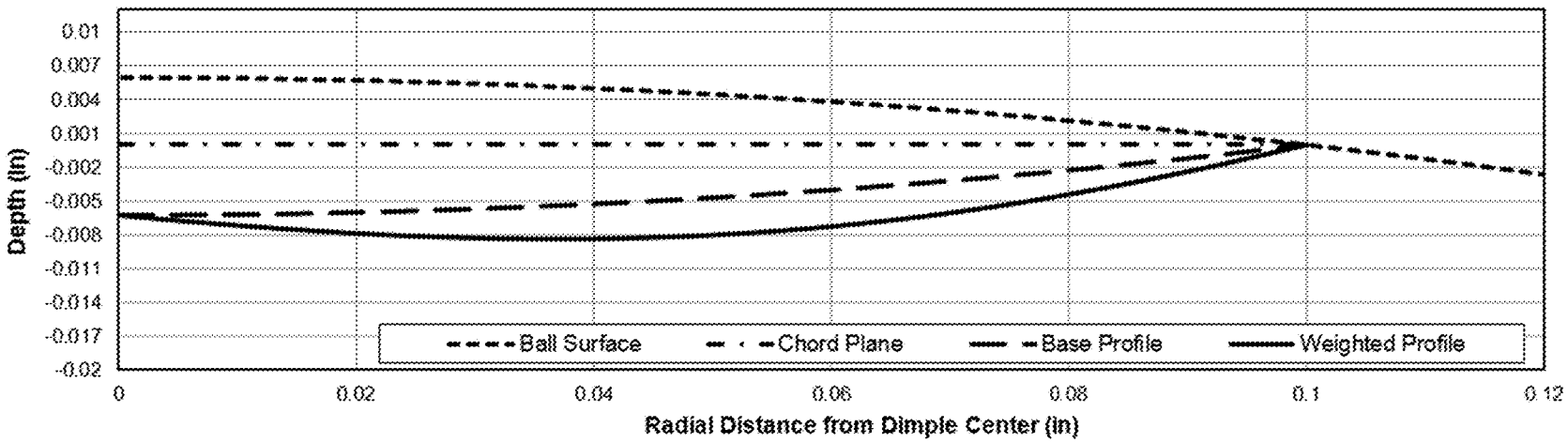
FIG. 13 shows a dimple cross-sectional profile defined by the product of a spherical base profile and a weighting function according to another embodiment of the present invention.
Figure 14:
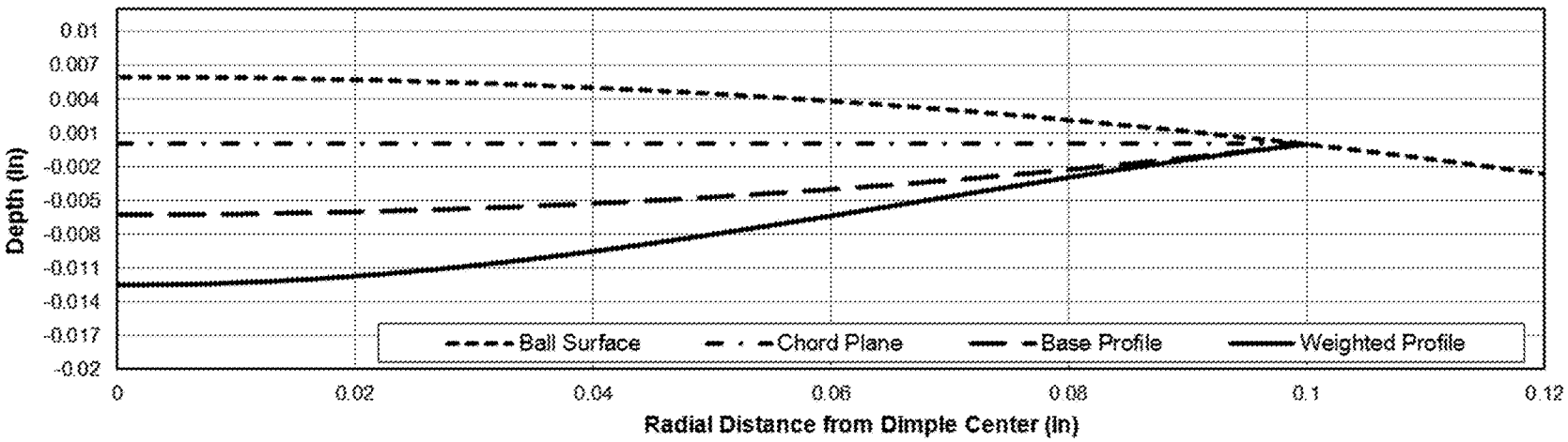
FIG. 14 shows a dimple cross-sectional profile defined by the product of a spherical base profile and a weighting function according to another embodiment of the present invention.

Golf balls of the present invention include dimples having a cross-sectional shape defined by a weighted profile, the weighted profile being the product of a base dimple profile and at least one weighting function. Suitable base dimple profiles include those that can be defined by a single function, including, but not limited to, spherical, conical, catenary, elliptical, polynomial, Witch of Agnesi, frequency, Neiles parabola, and cosine profiles, and those that are defined by two or more functions, including, but not limited to, profiles comprising a top conical edge and a bottom spherical cap. Profiles comprising a top conical edge and a bottom spherical cap are further disclosed, for example, in U.S. Patent Application Publication No. 2010/0240474, the entire disclosure of which is hereby incorporated herein by reference. In a particular embodiment, the base dimple profile is defined by a single continuous, differentiable function.

One or more continuous weighting functions are applied as multiplicative constructs to the base dimple profile to produce the weighted dimple profile. For base profiles defined by a single function the weighting function(s) are applied to the entire dimple profile. For base profiles defined by two or more functions, the weighting function(s) are applied independently to one or more of the base profile functions.

Typical weighting function forms include, but are not limited to, polynomial, exponential, and trigonometric, Gaussian or linear combinations thereof.

In a particular embodiment, one or more continuous weighting functions are applied as multiplicative constructs to a base dimple profile defined by a single continuous, differentiable function, resulting in a continuous, differentiable weighted dimple profile. It will be appreciated that the weighting function allows dimple profile refinement through biasing derivatives of the function profile, thus allowing specific regions of the dimple cross-section to be altered. This allows unique dimple profiles to be created and provides greater control and flexibility of the final golf ball surface. Furthermore, the method is well suited to common hob manufacturing methods.

Non-limiting examples of particularly suitable weighting functions are shown in Table 1 below.

TABLE 1

| Example No. | Weighting Function |
|---|---|
| 1 | w 1 |
| 2 | w x |
| 3 | w $x^2$ |
| 4 | w $x^3$ |
| 5 | w $x^4$ |
| 6 | w $x^4$ $x^3$ |
| 7 | w $x^2/5$ $3x^3$ $x^4$ |
| 8 | w $10x^2$ $3x^4$ |
| 9 | w $3x^4$ $x^3/2$ 10x |
| 10 | w x |
| 11 | w $x^3$ |
| 12 | w $x^3$ $x^4$ 2x |
| 13 | w sin(x) |
| 14 | w cos(x) |
| 15 | w $x^5$ |
| 16 | w $e^x$ |
| 17 | w $e^x$ |
| 18 | w $(e^{2x})\sin(x)$ |
| 19 | w $e^{2x}x^3$ |
| 20 | w cos(4.9x)/5 |
| 21 | w cos(1.89x)/2 |
| 22 | w sin(3.64x)/1.5 |
| 23 | w sin(6x)/3 |

FIGS. 1-23 show the final weighted profile defined by the product of a spherical base profile and each of weighting functions 1-23 in Table 1, respectively, with a base profile such that the golf ball diameter is 1.680 inches, the dimple diameter is 0.200 inches, and the base profile has a dimple edge angle of 14°, a chord depth of 0.0063 inches, a surface depth of 0.0122 inches, a dimple radius of 0.7953 inches, and a cap height of 0.0059 inches. The chord depth, equivalent spherical edge angle, edge angle, and weighted volume ratio of the final weighted profile illustrated in each of FIGS. 1-23 is given in Table 2 below.

TABLE 2

| | | | Final Weighted Profile | | | |
|---|---|---|---|---|---|---|
| FIG. # | Base Profile | Weighting Function | chord depth (inches) | Equivalent spherical edge angle (degrees) | edge angle (degrees) | weighted volume ratio |
| 1 | spherical | w 1 | 0.0126 | 21.08° | 20.95° | 2.00 |
| 2 | spherical | w x | 0.0063 | 17.75° | 20.94° | 1.53 |
| 3 | spherical | w $x^2$ | 0.0063 | 16.32° | 20.93° | 1.33 |

TABLE 2-continued

| FIG. # | Base Profile | Weighting Function | Final Weighted Profile: chord depth (inches) | Equivalent spherical edge angle (degrees) | edge angle (degrees) | weighted volume ratio |
|---|---|---|---|---|---|---|
| 4 | spherical | w $x^3$ | 0.0063 | 15.57° | 20.92° | 1.23 |
| 5 | spherical | w $x^4$ | 0.0063 | 15.13° | 20.90° | 1.17 |
| 6 | spherical | w $x^4$ $x^3$ | 0.0063 | 15.35° | 20.91° | 1.20 |
| 7 | spherical | w $x^2/5$ $3x^3$ $x^4$ | 0.0063 | 15.50° | 20.92° | 1.22 |
| 8 | spherical | w $10x^2$ $3x^4$ | 0.0063 | 16.05° | 20.93° | 1.29 |
| 9 | spherical | w $3x^4$ $x^3/2$ 10x | 0.0063 | 15.73° | 20.91° | 1.25 |
| 10 | spherical | w x | 0.0126 | 17.27° | 14.00° | 1.47 |
| 11 | spherical | w $x^3$ | 0.0126 | 19.45° | 14.02° | 1.77 |
| 12 | spherical | w $x^3$ $x^4$ 2x | 0.0126 | 17.49° | 14.01° | 1.50 |
| 13 | spherical | w sin(x) | 0.0063 | 18.93° | 20.95° | 1.70 |
| 14 | spherical | w cos(x) | 0.0126 | 18.43° | 14.00° | 1.63 |
| 15 | spherical | w $x^5$ | 0.0063 | 15.42° | 14.05° | 1.21 |
| 16 | spherical | w $e^x$ | 0.0063 | 17.04° | 20.94° | 1.43 |
| 17 | spherical | w $e^x$ | 0.0126 | 17.98° | 14.01° | 1.57 |
| 18 | spherical | w $(e^{2x})\sin(x)$ | 0.0063 | 14.98° | 14.02° | 1.15 |
| 19 | spherical | w $e^{2x}x^3$ | 0.0063 | 15.02° | 13.98° | 1.15 |
| 20 | Spherical | w cos(4.9x)/5 | 0.0050 | 14.00° | 13.76° | 1.00 |
| 21 | Spherical | w cos(1.89x)/2 | 0.0031 | 14.00° | 17.47° | 1.00 |
| 22 | Spherical | w sin(3.64x)/1.5 | 0.0063 | 14.00° | 11.41° | 1.00 |
| 23 | Spherical | w sin(6x)/3 | 0.0063 | 14.00° | 14.02° | 1.00 |

For purposes of the present disclosure, a spherical base profile is defined by the following function:

$$y = -\sqrt{R^2 - x^2} + \sqrt{R^2 - \left(\frac{d}{2}\right)^2}$$

Where, for the above formula, the origin is located along the dimple axis intersecting the chord plane at y=0, and wherein $$R = \frac{-d}{2\cos\left(\frac{\theta\pi}{180} + a\cos\left(\frac{d}{D}\right)\right)};$$

=the dimple edge angle, in degrees;
d=the dimple diameter, in inches; and
D=the diameter of the golf ball, in inches.

TABLE 3

Figure 15:
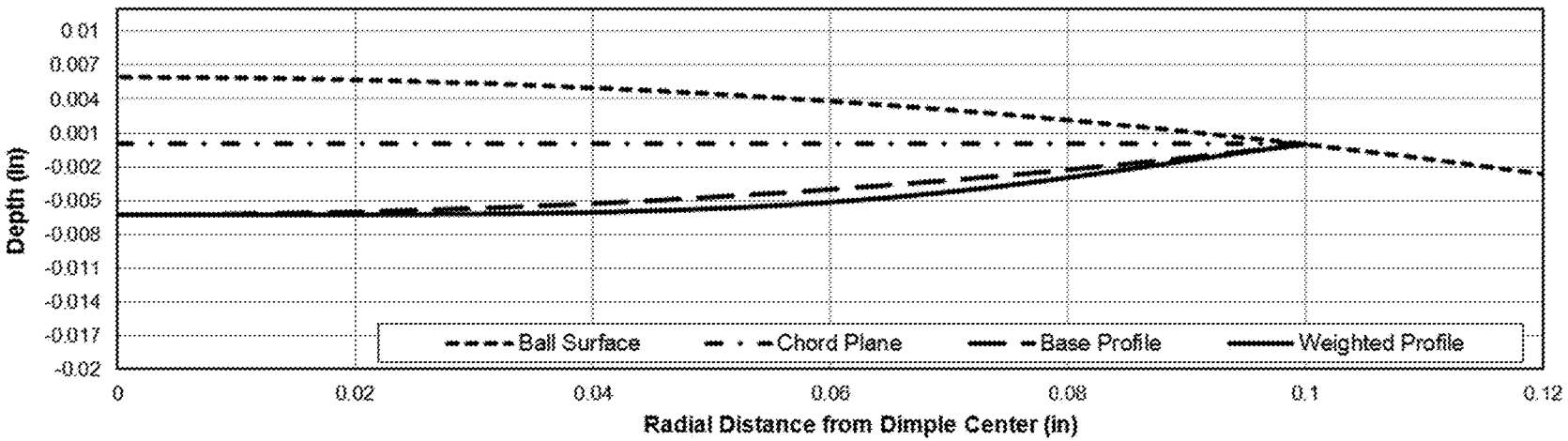
FIG. 15 shows a dimple cross-sectional profile defined by the product of a spherical base profile and a weighting function according to another embodiment of the present invention.
Figure 16:
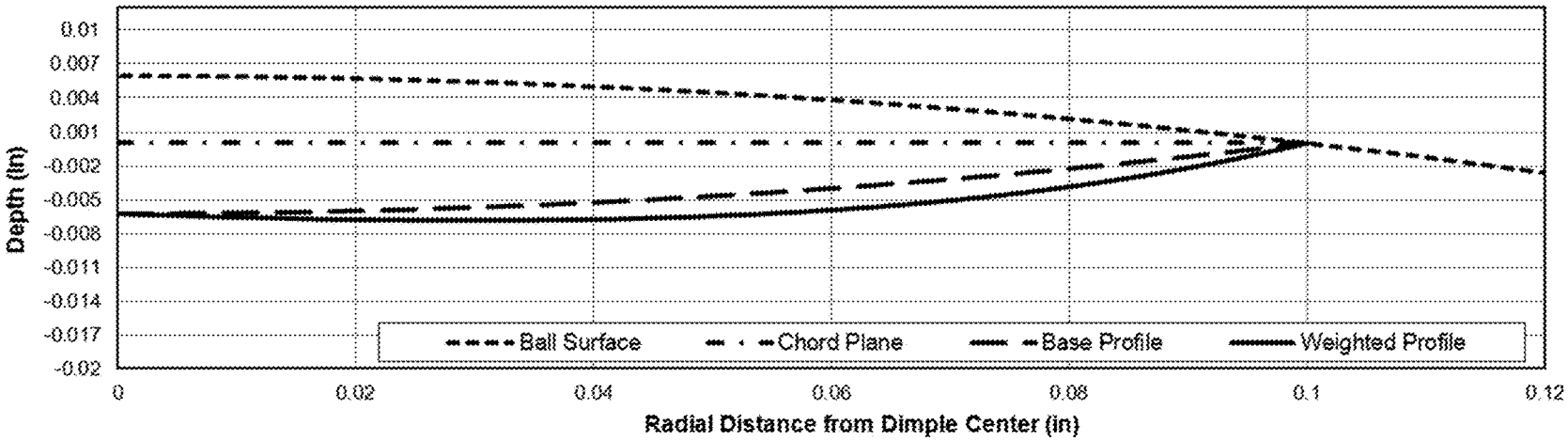
FIG. 16 shows a dimple cross-sectional profile defined by the product of a spherical base profile and a weighting function according to another embodiment of the present invention.
Figure 17:
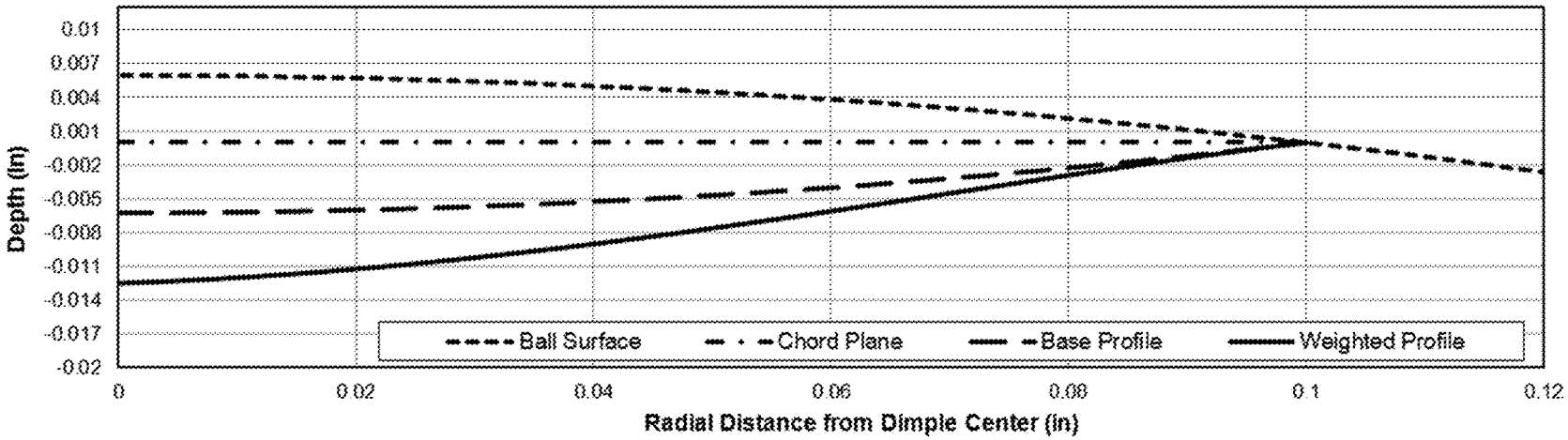
FIG. 17 shows a dimple cross-sectional profile defined by the product of a spherical base profile and a weighting function according to another embodiment of the present invention.
Figure 18:
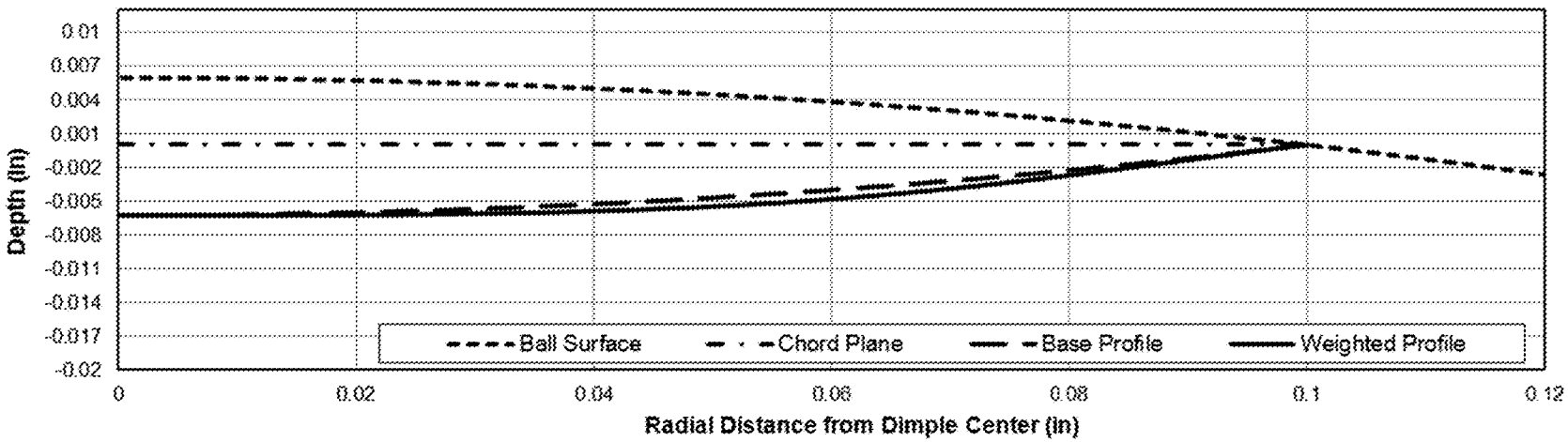
FIG. 18 shows a dimple cross-sectional profile defined by the product of a spherical base profile and a weighting function according to another embodiment of the present invention.
Figure 19:
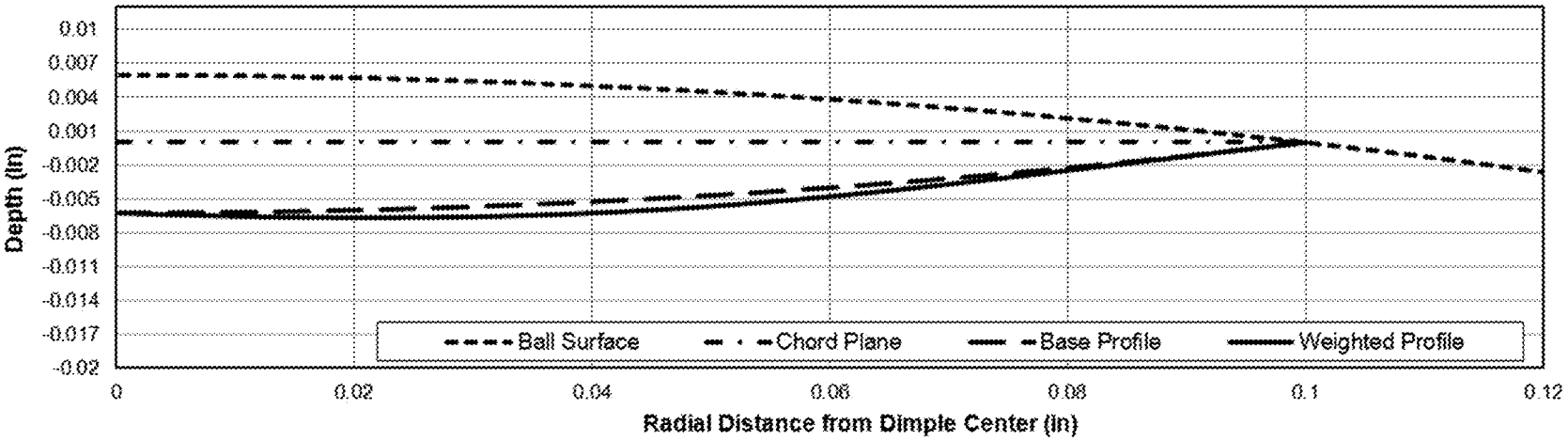
FIG. 19 shows a dimple cross-sectional profile defined by the product of a spherical base profile and a weighting function according to another embodiment of the present invention.
Figure 20:
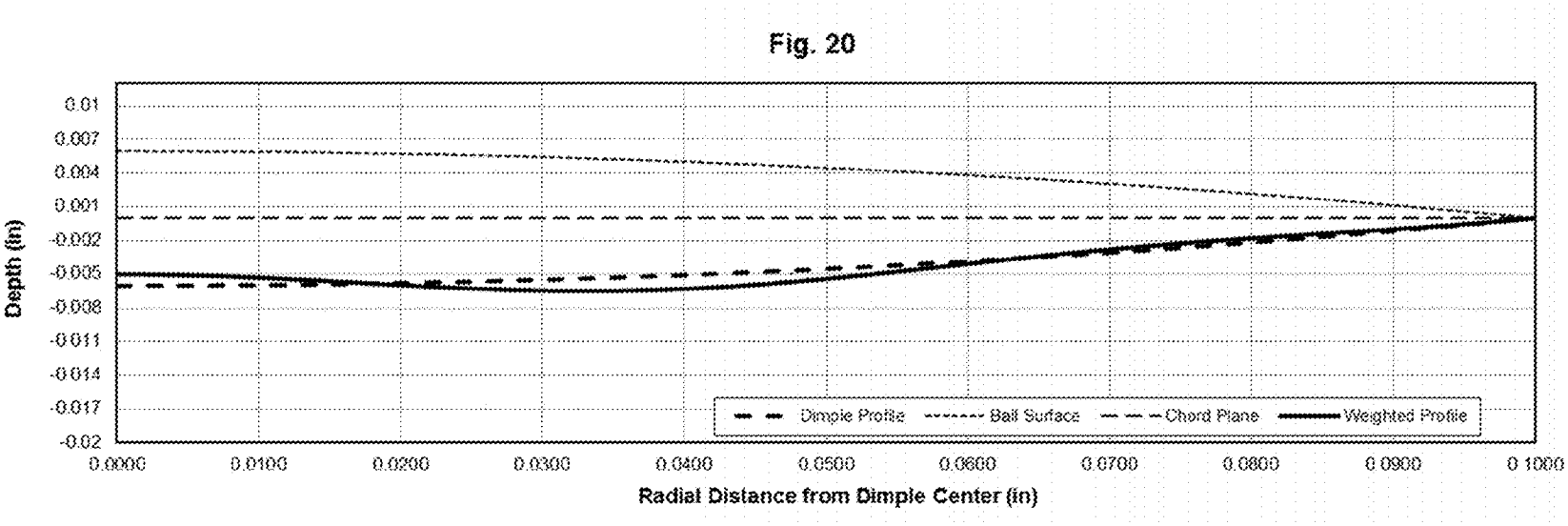
FIG. 20 shows a dimple cross-sectional profile defined by the product of a spherical base profile and a weighting function according to another embodiment of the present invention.
Figure 21:
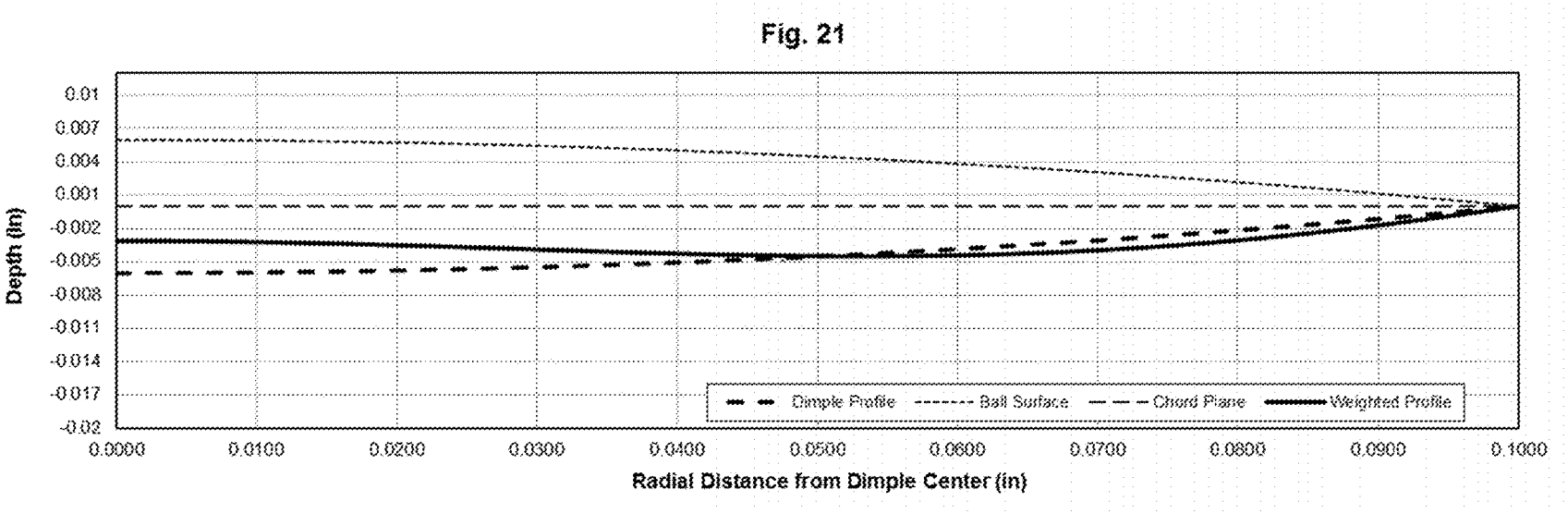
FIG. 21 shows a dimple cross-sectional profile defined by the product of a spherical base profile and a weighting function according to another embodiment of the present invention.
Figure 22:
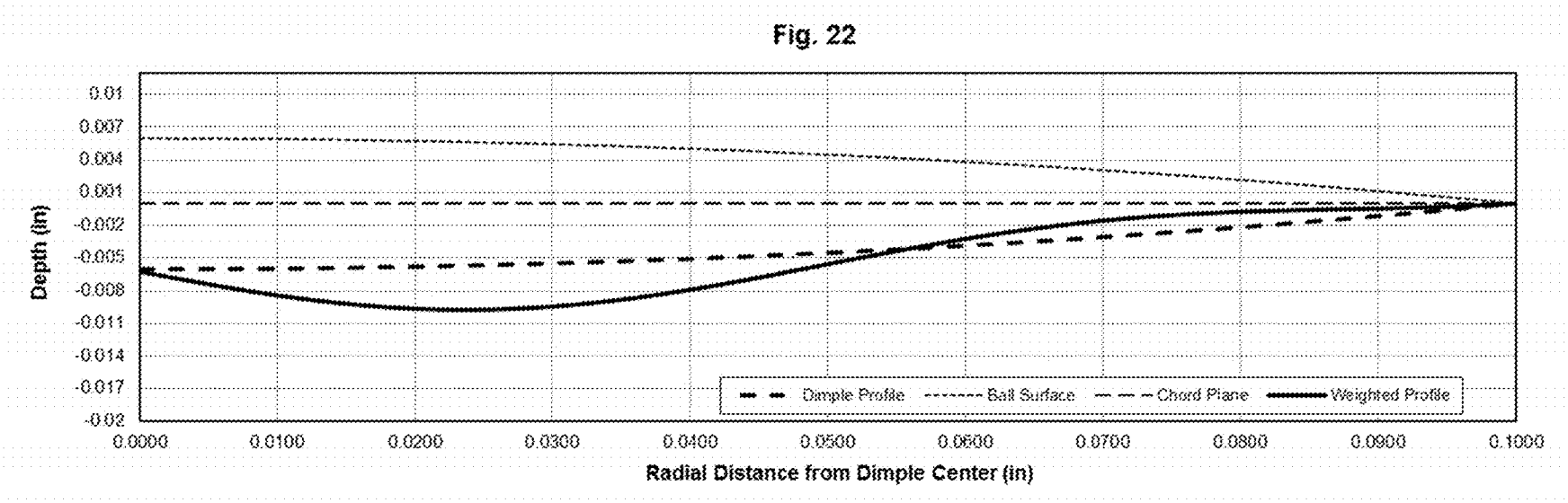
FIG. 22 shows a dimple cross-sectional profile defined by the product of a spherical base profile and a weighting function according to another embodiment of the present invention.
Figure 23:
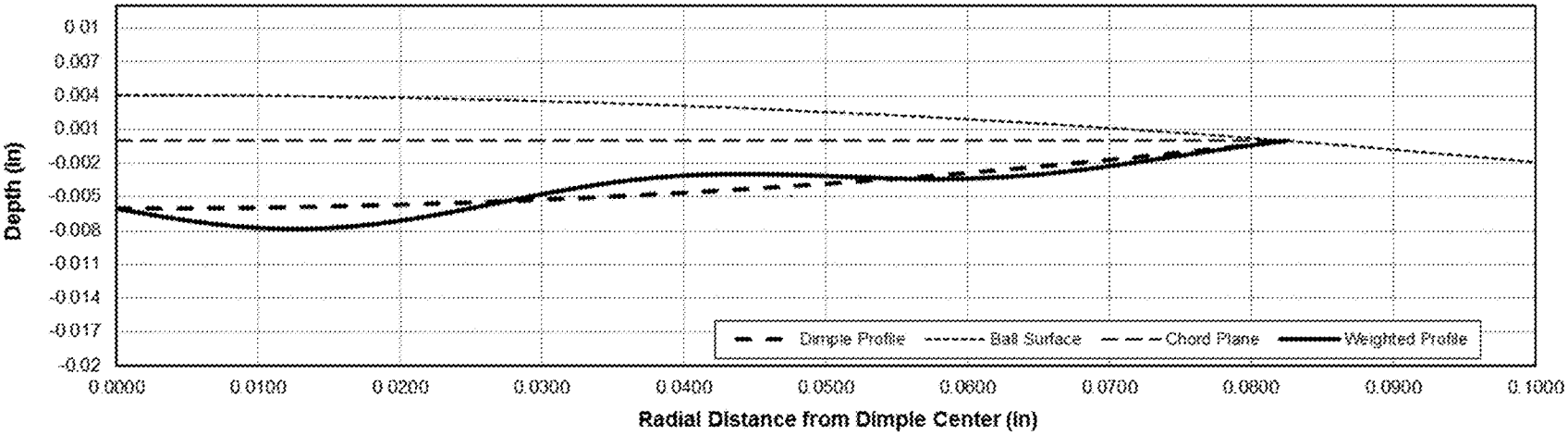
FIG. 23 shows a dimple cross-sectional profile defined by the product of a spherical base profile and a weighting function according to another embodiment of the present invention.

| FIG. | Edge Angle | Volume | Chord Depth |
|---|---|---|---|
| FIG. 1 | D | D | D |
| FIGS. 2-9, 13, 16 | D | D | S |
| FIGS. 10-12, 14, 17 | S | D | D |
| FIGS. 15, 18, 19 | S | D | S |
| FIG. 20 | S | S | D |
| FIG. 21 | D | S | D |
| FIG. 22 | D | S | S |
| FIG. 23 | S | S | S |

In Table 3, S signifies that the property for the base dimple profile and the weighted dimple profile are the same and D signifies that the property for the base dimple profile and the weighted dimple profile are different. Due to the nature of manufacture, differences in edge angle of less than about 0.25 degrees are considered substantially the same. Similarly, dimensional differences in dimple chord depth of about 0.0003 inches or less would constitute substantially the same chordal depth. Lastly, differences in chordal volume of about $3.510^6$ inches squared or less would constitute substantially the same chordal volume.

A golf ball according to the present invention has a plurality of recessed dimples on the surface thereof, where the dimples have a cross-sectional profile defined by a weighted function, where the weighted function is the multiplication of a single continuous, differentiable function and at least one weighting function. The weighting function is selected from the group consisting of polynomial, exponential and trigonometric functions. Examples of these functions are listed in Table 1, and the resulting weighted dimple profiles, from the use of these functions, is shown in FIGS. 1-23 and Table 2. The cross-sections of half of a dimple profile are depicted in each figure, showing the dimple profile from the dimple center to the outer edge or golf ball surface. Specifically, three dashed lines are shown depicting the ball surface, chord plane and a base profile. For the examples, one base profile is used. All examples started with a spherical base profile having a dimple diameter of 0.2 inches, edge angle of 14°, and a chord depth, or maximum dimple depth at the center of the dimple measured from the chord plane of 0.0063 inches. This selected base profile is then weighted with a weighting function, for example by multiplying with a function chosen from Table 1, to achieve a weighted dimple profile, the solid line, as depicted in FIGS. 1-23. As is readily apparent from FIGS. 1-23 and shown in Table 3, the base dimple profile and the weighted dimple profile have the same dimple diameters; however, they have one or more distinctly different dimple features; namely a different edge angle, volume, chord depth or dimple profile shape. Thus, the resulting claimed weighted dimple profile is uniquely different from the initial base dimple profile.

Figure 24:
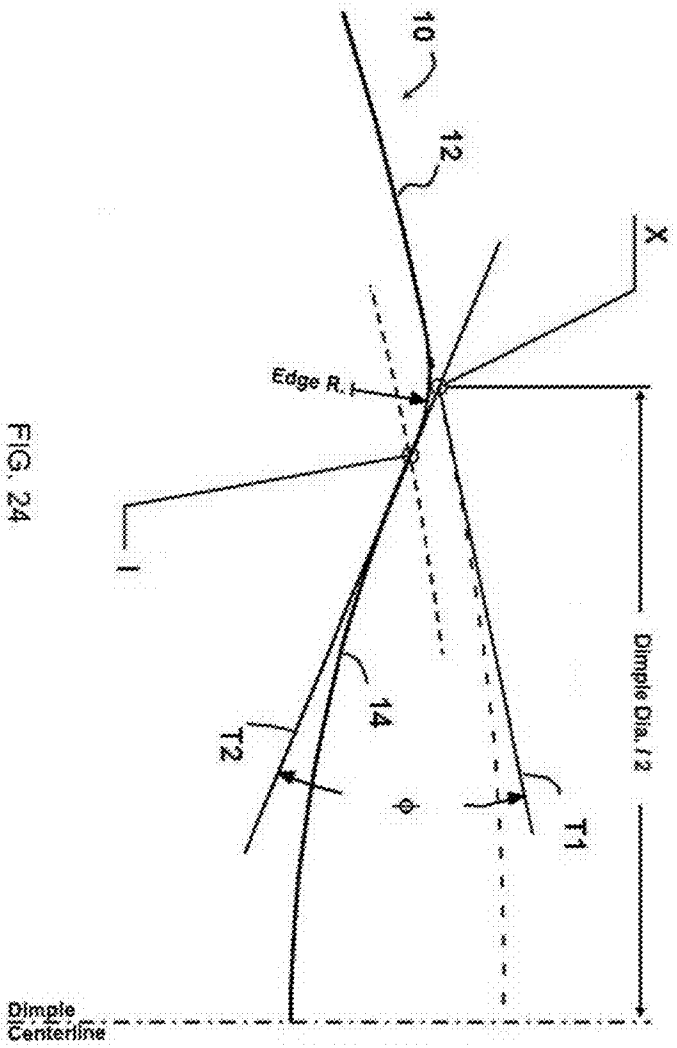
FIG. 24 is a partial sectional view of a dimple of a finished ball including layers of paint and a clear coat.

Turning to FIG. 24, ball 10 is shown as a finished ball including layers of paint and clear coat which creates a varied curvature at the demarcation between ball surface 12 and dimple wall 14. This curvature makes the location of the dimple edge indistinct. In this case, the edge angle is defined to be the angle between tangents T1 and T2. T2 is the tangent to the dimple wall 14 at the inflection point I. T1 is the tangent to the ball periphery surface 12 at point X which is the intersection of T2 and periphery 12.

Figure 25A:
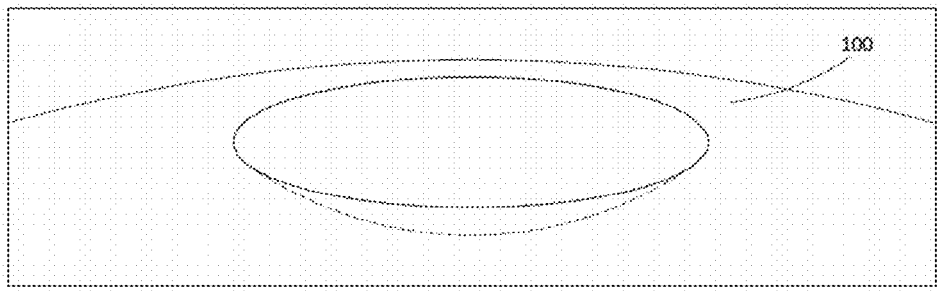
FIGS. 25*a*-25*d* are isometric views of a dimple depicting the enclosed chord volume between the dimple surface and chord plane.
Figure 25B:
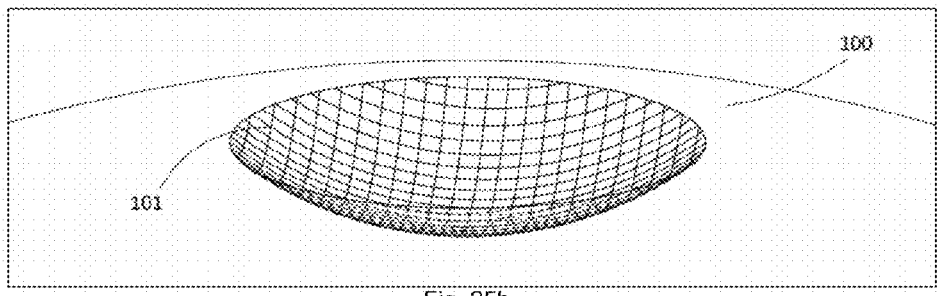
Figure 25C:
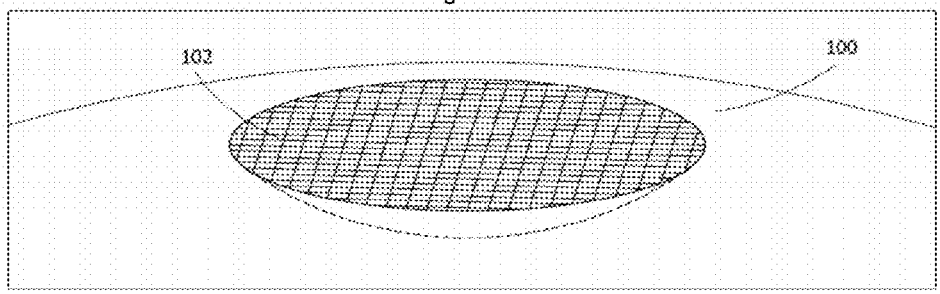
Figure 25D:
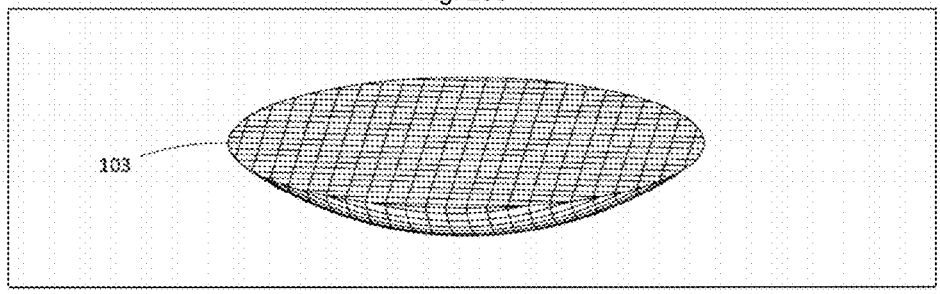

As shown in Table 2, the final weighted dimple profile has a chord depth, an equivalent spherical edge angle, an edge angle, and weighted volume ratio. As will be understood to one of ordinary skill in the art, the equivalent spherical edge angle is the edge angle of a spherical dimple with an equivalent chord volume and diameter. For example, for the weighted dimple profile in FIG. 1 a spherical dimple with an equivalent chord volume and the same diameter would have an equivalent spherical edge angle of 21.08° while the edge angle as defined in FIG. 24 is about 20.95°. The equivalent spherical edge angle of the weighted dimple profile is preferably within a range having a lower limit of about 10° or 11° or 12° and an upper limit of 20° or 21° or 22°. Additionally, as is understood in the art, the weighted volume ratio is the ratio of the volume of the weighted dimple profile to the base dimple profile. The volumes of both the weighted dimple profile and the base dimple profile are calculated using the chord plane, and thus, are considered to be chord volumes. Referring to FIGS. 25*a*-25*d*, the chord volume 103 is shown. FIGS. 25*a*-25*c* depict the ball surface 100, the dimple surface 101 and the chord plane 102. FIG. 25*d* shows the enclosed volume of the dimple as the chord volume 103 bounded by the dimple surface 101 and the dimple chord plane 102. For example, as listed in Table 2 the weighted volume ratio for the weighted dimple profile in FIG. 1 is 2.00 using volumes calculated from the chord plane. Specifically, the weighted dimple profile shown in FIG. 1 has a volume that is two times the volume of the base dimple profile shown in FIG. 1 from the chord plane. The weighted dimple volume ratio of the weighted dimple profile to the base dimple profile is preferably within a range having a lower limit of 0.2 or 0.4 or 0.6 and an upper limit of 2 or 3 or 4.

It will be appreciated when viewing FIG. 1 that the base dimple profile and the weighted dimple profile have the same dimple diameter; however, the chord depth, edge angle and volume of the base dimple profile and the weighted dimple profile are different. It will also be appreciated from Table 2, that the weighted volume ratio is about 2.00.

As shown in FIGS. 2-9, 13 and 16, the base dimple profile and the weighted dimple profile have the same dimple diameter and the same chord depth; however, the volume and the edge angle of the base dimple profile and the weighted dimple profile are different. It will also be appreciated from Table 2, that the weighted volume ratio is about 1.17 to about 1.70.

FIGS. 10-12, 14 and 17 show that the base dimple profile and the weighted dimple profile have the same dimple diameter and the same edge angle; however, the volume and the chord depth of the base dimple profile and the weighted dimple profile are different. It will also be appreciated from Table 2, that the weighted volume ratio is about 1.47 to about 1.77.

Referring now to FIGS. 15, 18 and 19 it is apparent that the base dimple profile and the weighted dimple profile have the same dimple diameter, chord depth and edge angle; however, the volume of the base dimple profile and the weighted dimple profile are different. It will also be appreciated from Table 2, that the weighted volume ratio is about 1.15 to about 1.21.

As shown in FIG. 20, the base dimple profile and the weighted dimple profile have the same edge angle and volume; however, the chord depth of the base dimple profile and the weighted dimple profile are different. It will also be appreciated from Table 2, that the weighted volume ratio is about 1.00, meaning the volume of the base dimple profile and the weighted dimple profile are substantially the same.

FIG. 21 shows that the base dimple profile and the weighted dimple profile have the same dimple diameter and volume; however, the edge angle and chord depth of the base dimple profile and the weighted dimple profile are different. It will also be appreciated from Table 2, that the weighted volume ratio is about 1.00, meaning the volume of the base dimple profile and the weighted dimple profile are substantially the same.

When viewing FIG. 22 it is apparent that the base dimple profile and the weighted dimple profile have the same dimple diameter, volume and chord depth; however, the edge angle of the base dimple profile and the weighted dimple profile are different. It will also be appreciated from Table 2, that the weighted volume ratio is about 1.00, meaning the volume of the base dimple profile and the weighted dimple profile are substantially the same.

Finally, with regard to FIG. 23 it is apparent that the base dimple profile and the weighted dimple profile have the same dimple diameter, edge angle, volume and chord depth. It will be appreciated from the figure that the dimple profile shape of the base dimple profile and the weighted dimple profile are different, such that the cross-sectional shape of the dimple profiles are different. It will also be appreciated from Table 2, that the weighted volume ratio is about 1.00, meaning the volume of the base dimple profile and the weighted dimple profile are substantially the same.

Figure 26:
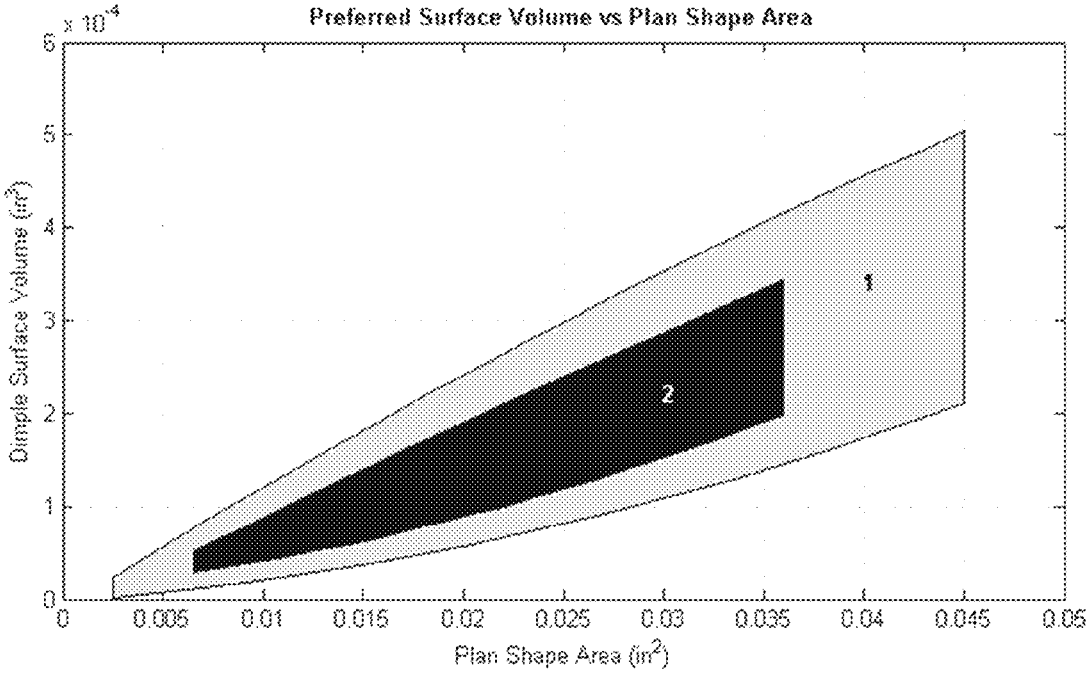
FIG. 26 shows the preferred and most preferred plan shape area and surface volume ranges according to the present invention.

Referring now to FIG. 26, the preferred plan shape area and total dimple volume are shown. The dimple plan shapes are preferably circular. The plan shape area is based on a planar view of the dimple plan shape, such that the viewing plane is normal to an axis connecting the center of the ball to the point of the calculated surface depth. The dimple volume is the total volume encompassed by the dimple shape and the surface of the golf ball. The plan shape area and total dimple volume preferably fall within range 1 in FIG. 26. More preferably, the dimple shape area and total dimple volume fall within range 2 shown in FIG. 26. More specifically, preferably the dimple plan shape area is from about 0.0025 $in^2$ to about 0.045 $in^2$. More preferably, the dimple plan shape area is from about 0.0065 $in^2$ to about 0.036 $in^2$. Preferably, the dimple surface volume is from about $0.110^5$ $in^3$ to about $5.010^4$ $in^3$. More preferably, the dimple surface volume is from about $0.310^4$ $in^3$ to about $3.310^4$ $in^3$.

Figure 27:
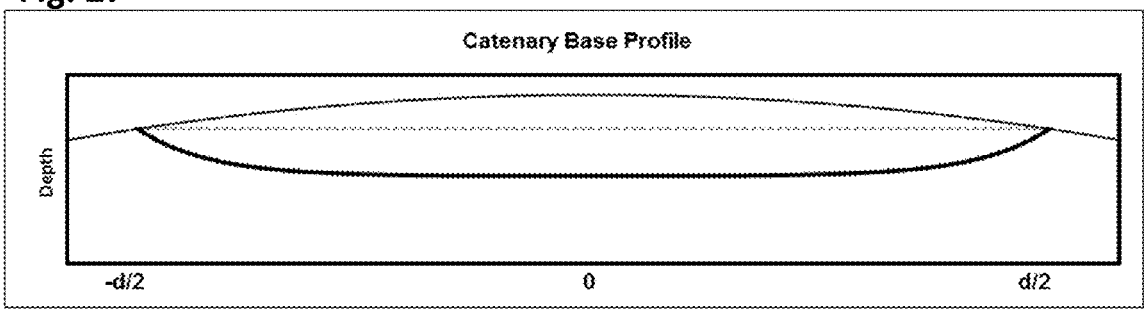
FIG. 27 shows a dimple cross-sectional profile of the catenary base dimple profile.

Dimple profiles of the present invention are defined by a catenary base profile to which a weighting function is applied as a multiplier as discussed above. An example of a catenary base profile is shown in FIG. 27, and described in U.S. Pat. No. 7,641,572, incorporated herein by reference in its entirety. For purposes of the present disclosure, a catenary base profile is defined by the following function:

$$y = \frac{d_c(\cosh(sf * x) - 1)}{\cosh\left(sf * \frac{D}{2}\right) - 1}$$

where, for the above formula, y is the vertical direction coordinate away from the center of the ball with 0 at the center of the dimple x=the horizontal (radial) direction coordinate from the dimple apex to the dimple surface with 0 at the center of the dimple;

sf=the shape factor;

$d_c$=the chordal depth of the dimple, in inches; and
D=the diameter of the dimple, in inches.

For the examples in FIGS. 28*a*-29*c*, one base catenary profile is used. All examples started with a catenary base profile having a dimple diameter of 0.2 inches, a chord depth of 0.0035 inches and a shape factor of 100. It will be appreciated that a base profile may be used having a chord depth, or maximum dimple depth at the center of the dimple measured from the chord plane of 0.0015 to 0.0070 inches, and a shape factor of 30 to 300. The selected base profile is then weighted with a weighting function, for example by multiplying with a function chosen from Table 1, to achieve a weighted dimple profile.

It will be appreciated that multiple weighting functions can be used. Regardless, the resulting dimple profile may remain smooth and continuous from the center of the dimple to the dimple edge, from about x=0 to about x=d/2. It will be appreciated that it will not necessarily be smooth across the entire dimple profile from d/2 to d/2 because a discontinuity may exist at x=0.

In one embodiment, the base profile is modified using a pure weighted method. This method produces a weighted function, f(x), in accordance with equation 1, as follows:

$$f(x)=g(x)*w(x) \quad (1)$$

where,
g(x) is the Base Profile Function and
w(x) is the Weighting function

The pure weighting method means the resulting weighted function is purely a percentage of the original base profile function as defined by the weighting function.

In another embodiment, the base profile is modified using a profile relative weighted method. This method produces a weighted function, f(x), in accordance with equation 2, as follows:

$$f(x)=g(x)*(1\,w(x)) \quad (2)$$

where again,
g(x) is the Base Profile Function and
w(x) is the Weighting function The profile relative method applies the given weighting function relative to the existing base profile function such that the weighted value is added to the existing base curve to obtain the resulting weighted function.

The weighting function w(x) is always continuous and applied from the dimple center at x=0 to the dimple perimeter at x=d/2 where d is the dimple diameter. Further, g(x) and f(x) are equal at x=d/2, the dimple chord plane.

It will be appreciated that both the profile relative method and the pure weighting method hold to the construct that the weighted function results from the multiplication of a base profile function and a weighting function. Further, the domain of the function w(x) is such that 0w(x)1 while the calculated weighted function range differs between the profile relative and pure weighting methods.

It will be appreciated that similar to Table 3 above, the catenary base dimple profile and the resulting weighted dimple profile may have the same or different properties of diameter, shape factor, volume and chord depth.

Figure 28A:
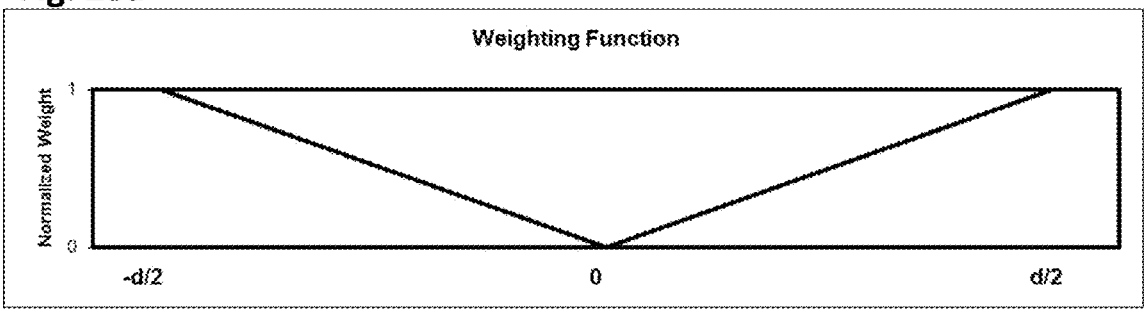
FIGS. 28*a*-28*c* shows the weighting function w(x)=x, the full weighted profile f(x) using profile relative weighting and the full weighted profile f(x) using pure weighting.
Figure 28B:
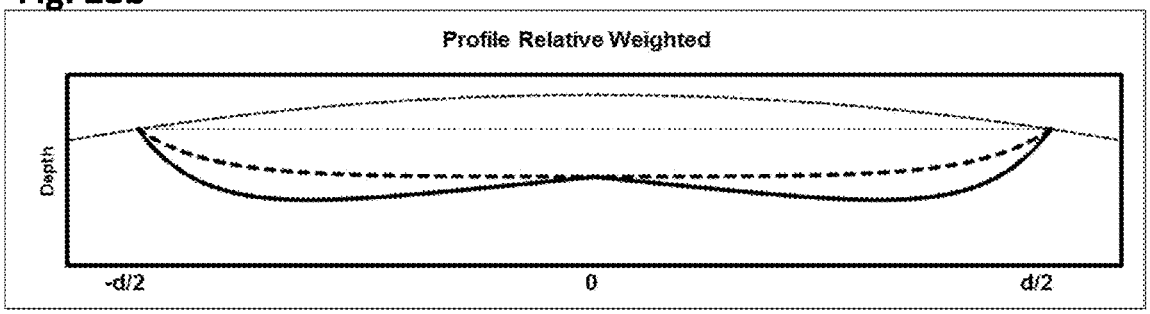
Figure 28C:
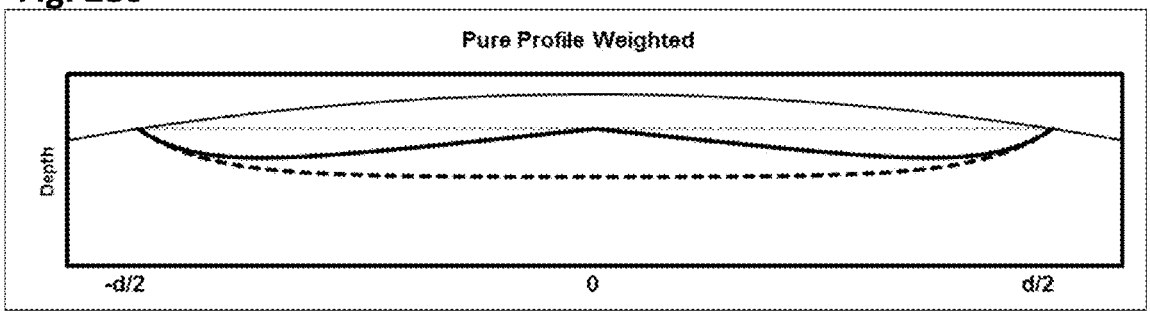

An example is shown in FIGS. 28*a*-*c*. The catenary base function of FIG. 27 is modified using the weighting function shown in FIG. 28*a:*

$$w(x)=x$$

The weighting function is continuous from the dimple center to the dimple perimeter and the weighting is applied as such thereby creating the weighted function representing a half dimple profile that is revolved about an axis through the dimple center to create the dimple surface. A cross sectional view of the resulting dimple is shown in FIGS. 28*b* and 28*c* using the two different weighting methods. FIG. 28*b* is the resulting cross-section when using the profile relative method, while FIG. 28*c* is the resulting cross-section when using the pure weighted method.

Figure 29A:
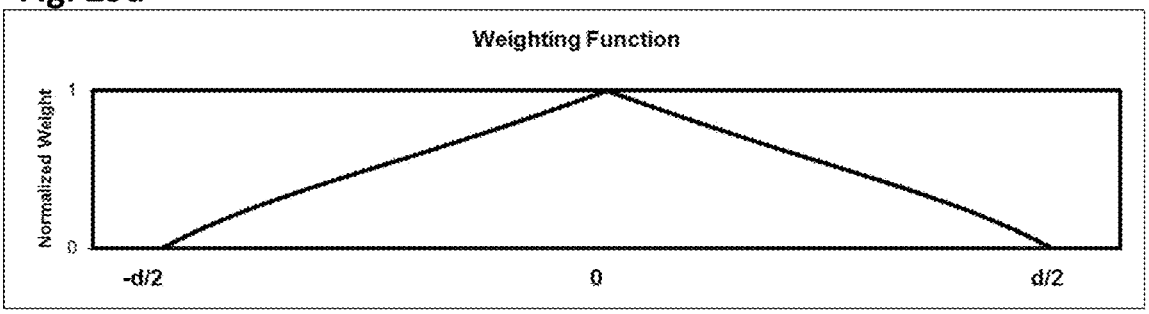
FIGS. 29*a*-29*c* shows the weighting function w(x)=$x^4$ $x^3$2x, the full weighted profile f(x) using profile relative weighting, and the full weighted profile f(x) using pure weighting.
Figure 29B:
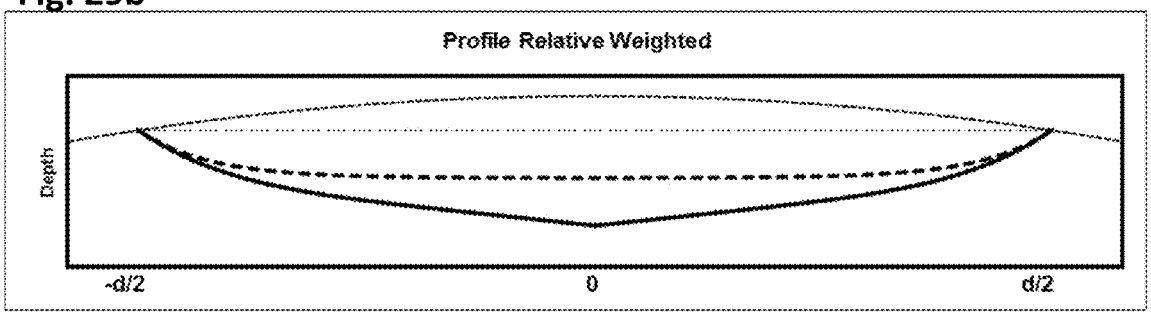
Figure 29C:
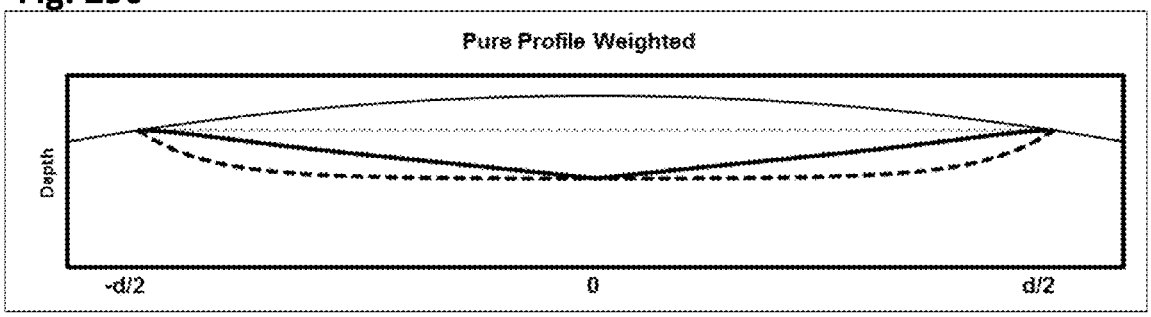

Another example is shown in FIGS. 29*a*-29*c*. The catenary base function of FIG. 27 is modified using the weighting function shown in FIG. 29*a:*

$$w(x)=x^4+x^3 2x$$

This weighting function is continuous from the dimple center to the dimple perimeter and the weighting is applied as such thereby creating the weighted function representing a half dimple profile that is revolved about an axis through the dimple center to create the dimple surface. Cross-sectional views of the resulting dimple are shown in FIGS. 29*b* and 29*c* using the two different weighting methods. FIG. 29*b* is the resulting cross-section when using the profile relative method, and FIG. 29*c* is the resulting cross-section when using the pure weighted method.

It will be appreciated that the above are examples showing use of a particular base function with a particular weighting function with either the profile relative method or the pure weighting method. These weighting methods may be used with any of the equations discussed herein, or any other equation known to one of skill in the art.

The present invention is not limited by any particular dimple pattern. Examples of suitable dimple patterns include, but are not limited to, phyllotaxis-based patterns; polyhedron-based patterns; and patterns based on multiple copies of one or more irregular domain(s) as disclosed in U.S. Pat. No. 8,029,388, the entire disclosure of which is hereby incorporated herein by reference; and particularly dimple patterns suitable for packing dimples on seamless golf balls. Non-limiting examples of suitable dimple patterns are further disclosed in U.S. Pat. Nos. 7,927,234, 7,887,439, 7,503,856, 7,258,632, 7,179,178, 6,969,327, 6,702,696, 6,699,143, 6,533,684, 6,338,684, 5,842,937, 5,562,552, 5,575,477, 5,957,787, 5,249,804, 5,060,953, 4,960,283, and 4,925,193, and U.S. Patent Application Publication Nos. 2006/0025245, 2011/0021292, 2011/0165968, and 2011/0183778, the entire disclosures of which are hereby incorporated herein by reference. Non-limiting examples of seamless golf balls and methods of producing such are further disclosed, for example, in U.S. Pat. Nos. 6,849,007 and 7,422,529, the entire disclosures of which are hereby incorporated herein by reference.

In a particular embodiment, the dimple pattern provides for overall dimple coverage of 60% or greater, or 65% or greater, or 75% or greater, or 80% or greater, or 85% or greater, or 90% or greater.

Golf balls of the present invention typically have a dimple count within a limit having a lower limit of 250 and an upper limit of 350 or 400 or 450 or 500. In a particular embodiment, the dimple count is 252 or 272 or 302 or 312 or 320 or 328 or 332 or 336 or 340 or 352 or 360 or 362 or 364 or 372 or 376 or 384 or 390 or 392 or 432.

Preferably, at least 30%, or at least 50%, or at least 60%, or at least 80%, or at least 90%, or at least 95% of the total number of dimples have a cross-sectional profile defined by the product of a base function and at least one weighting function, with the remaining dimples, if any, having a cross-sectional profile based on any known dimple profile shape including, but not limited to, parabolic curves, ellipses, spherical curves, saucer-shapes, sine curves, truncated cones, flattened trapezoids, and catenary curves. Among the dimples having a cross-sectional profile defined by the present invention, the profile of one dimple may be the same as or different from the profile of another dimple. Similarly, among the remaining dimples, if any, having a known dimple profile shape, the profile of one dimple may be the same as or different from the profile of another dimple.

The diameter of the dimples is preferably within a range having a lower limit of 0.090 inches or 0.100 inches or 0.115 inches or 0.125 inches and an upper limit of 0.185 inches or 0.200 inches or 0.225 inches.

The chord depth of the dimples is preferably within a range having a lower limit of 0.002 inches or 0.003 inches or 0.004 inches or 0.006 inches and an upper limit of 0.008 inches or 0.010 inches or 0.012 inches or 0.014 inches or 0.016 inches.

The present invention is not limited by any particular golf ball construction or any particular composition for forming the golf ball layers. For example, functionally weighted curves of the present invention can be used to form dimple profiles on one-piece, two-piece (i.e., a core and a cover), multi-layer (i.e., a core of one or more layers and a cover of one or more layers), and wound golf balls, having a variety of core structures, intermediate layers, covers, and coatings.

When numerical lower limits and numerical upper limits are set forth herein, it is contemplated that any combination of these values may be used.

All patents, publications, test procedures, and other references cited herein, including priority documents, are fully incorporated by reference to the extent such disclosure is not inconsistent with this invention and for all jurisdictions in which such incorporation is permitted.

While the illustrative embodiments of the invention have been described with particularity, it will be understood that various other modifications will be apparent to and can be readily made by those of ordinary skill in the art without departing from the spirit and scope of the invention. Accordingly, it is not intended that the scope of the claims appended hereto be limited to the examples and descriptions set forth herein, but rather that the claims be construed as encompassing all of the features of patentable novelty which reside in the present invention, including all features which would be treated as equivalents thereof by those of ordinary skill in the art to which the invention pertains.

What is claimed is:

1. A golf ball having a plurality of recessed dimples on the surface thereof, wherein at least a portion of the recessed dimples have a non-spherical cross-sectional profile and a chord depth range from 0.006 inches to 0.016 inches, where the non-spherical cross-sectional profile is defined by a weighted function, wherein the weighted function is the multiplication of a catenary base profile function g(x) and at least one weighting function w(x) selected from the group consisting of polynomial, exponential, and trigonometric functions, the weighted function resulting in a non-spherical cross-sectional weighted dimple profile different from the base dimple profile, wherein the base dimple profile is modified using a profile relative method, wherein $$f(x)=g(x)*(1\,w(x))$$

wherein the weighting function w(x) is continuous and applied from the dimple center at x=0 to the dimple perimeter at x=d/2 where d is the dimple diameter, and g(x) and f(x) are equal at x=d/2.

2. The golf ball of claim 1, where the dimple diameter of the base dimple profile and the weighted dimple profile is substantially the same, while shape factor or volume or dimple chord depth of the base dimple profile and the weighted dimple profile are different.

3. The golf ball of claim 2, wherein shape factor, volume and chord depth of the base dimple profile and the weighted dimple profile are different.

4. The golf ball of claim 2, wherein the shape factor and the dimple chord depth of the base dimple profile and the weighted dimple profile are different, and the volume of the base dimple profile and the weighed dimple profile are the same.

5. The golf ball of claim 2, wherein the volume and the dimple chord depth of the base dimple profile and the weighted dimple profile are different and the shape factor of the base dimple profile and the weighted dimple profile are the same.

6. The golf ball of claim 2, wherein the shape factor and volume of the base dimple profile and the weighted dimple profile are different and the dimple chord depth of the base dimple profile and the weighted dimple profile are the same.

7. The golf ball of claim 1, wherein the ratio of chord volume of the weighted dimple profile to the chord volume of the base dimple profile is greater than or equal to 1.

8. The golf ball of claim 1, wherein the weighted function is a linear combination of two or more weighting functions.

9. The golf ball of claim 1, wherein the dimples have a circular plan shape with an area.

10. The golf ball of claim 9, wherein the dimple plan shape area is between about 0.0025 $in^2$ to about 0.045 $in^2$.

11. The golf ball of claim 10, wherein the dimple surface volume is between $0.110^5$ $in^3$ to about $5.010^4$ $in^3$.

12. A golf ball having a plurality of recessed dimples on the surface thereof, wherein at least a portion of the recessed dimples have a non-spherical cross-sectional profile and a chord depth range from 0.006 inches to 0.016 inches, where the non-spherical cross-sectional profile is defined by a weighted function, wherein the weighted function is the multiplication of a catenary base profile function g(x) and at least one weighting function w(x) selected from the group consisting of polynomial, exponential, and trigonometric functions, the weighted function resulting in a non-spherical cross-sectional weighted dimple profile different from the base dimple profile, wherein the base dimple profile is modified using a pure weighting method, wherein $$f(x)=g(x)*(w(x))$$

wherein the weighting function w(x) is continuous and applied from the dimple center at x=0 to the dimple perimeter at x=d/2 where d is the dimple diameter, and g(x) and f(x) are equal at x=d/2.

13. The golf ball of claim 12, where the dimple diameter of the base dimple profile and the weighted dimple profile is substantially the same, while shape factor or volume or dimple chord depth of the base dimple profile and the weighted dimple profile are different.

14. The golf ball of claim 13, wherein shape factor, volume and chord depth of the base dimple profile and the weighted dimple profile are different.

15. The golf ball of claim 13, wherein the shape factor and the dimple chord depth of the base dimple profile and the weighted dimple profile are different, and the volume of the base dimple profile and the weighed dimple profile are the same.

16. The golf ball of claim 13, wherein the volume and the dimple chord depth of the base dimple profile and the weighted dimple profile are different and the shape factor of the base dimple profile and the weighted dimple profile are the same.

17. The golf ball of claim 13, wherein the shape factor and volume of the base dimple profile and the weighted dimple profile are different and the dimple chord depth of the base dimple profile and the weighted dimple profile are the same.

18. The golf ball of claim 12, wherein the ratio of chord volume of the weighted dimple profile to the chord volume of the base dimple profile is less than or equal to 1.

19. The golf ball of claim 12, wherein the weighted function is a linear combination of two or more weighting functions.

20. The golf ball of claim 12, wherein the dimples have a circular plan shape with an area.

21. The golf ball of claim 20, wherein the dimple plan shape area is between about 0.0025 $in^2$ to about 0.045 $in^2$.

22. The golf ball of claim 21, wherein the dimple surface volume is between about $0.110^5$ $in^3$ to about $5.010^4$ $in^3$.